United States Patent [19]

Grabovac

[11] Patent Number: 4,658,875

[45] Date of Patent: Apr. 21, 1987

[54] KNIFE HOLDER

[76] Inventor: Bosko Grabovac, 19220 San Jose Ave., City of Industry, Calif. 91748

[21] Appl. No.: 842,903

[22] Filed: Mar. 24, 1986

[51] Int. Cl.[4] ..... B26D 1/12; B27G 13/04

[52] U.S. Cl. ..... 144/230; 82/36 R; 144/117 R; 144/218; 407/41; 407/49; 407/50

[58] Field of Search ..... 407/40, 41, 49, 50; 82/36 R; 144/162 R, 172, 174, 218, 230, 117 R

[56] References Cited

U.S. PATENT DOCUMENTS

| | | | |
|---|---|---|---|
| 874,871 | 12/1907 | Shimer | 144/230 |
| 3,854,511 | 12/1974 | Maier | 144/230 |
| 4,194,545 | 3/1980 | Kostermeier | 144/230 |
| 4,449,556 | 5/1984 | Colton | 144/230 |
| 4,530,263 | 7/1985 | Muntel | 82/36 R |

*Primary Examiner*—W. D. Bray

*Attorney, Agent, or Firm*—Georges A. Maxwell

[57] ABSTRACT

Improvements in standard planing knife holders for standard disposable double-edged planing knives which include spring means carried by the holders to engage the bottoms of related knife-receiving channels in related planing knife driving shafts to normally yieldingly urge the holders and their related knives radially outward in the channels and relative to related screw actuated clamping bars within said channels and engaging the holders and knives. An improvement comprises permanent magnets carried by the holders with south poles spaced from opposing rear surfaces of related channels and with north poles contacting and holding the knives assembled with the holders. The improvements also include secondary permanent magnets carried by the holders with south poles spaced from the knives and clamping bars and north poles contacting and holding the holders on said rear surfaces. The improvements include friction means at the opposing rear surfaces of the holders and channels to frictionally resist planar movement therebetween and including spring loaded balls shiftably carried by the holders and yieldingly engaging the rear surfaces of the channels.

7 Claims, 14 Drawing Figures

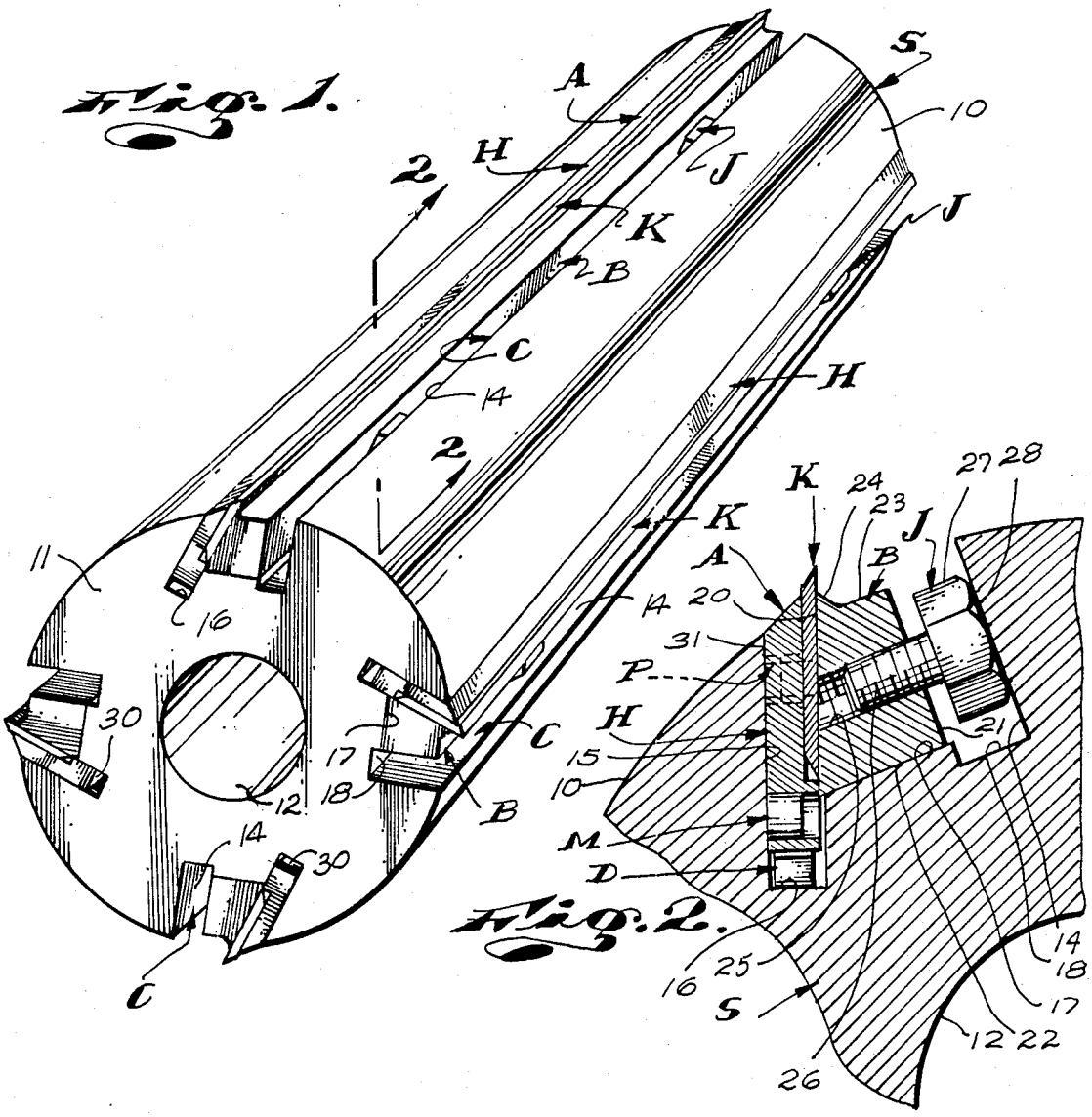
Fig. 1.
Fig. 2.
A
S
10
H
J
2
K
B
C
14
11
16
30
17
18
12
K
24
23
27
28
A
B
20
31
P
H
15
10
M
D
21
25
16
S
26
12
22
14
18
17
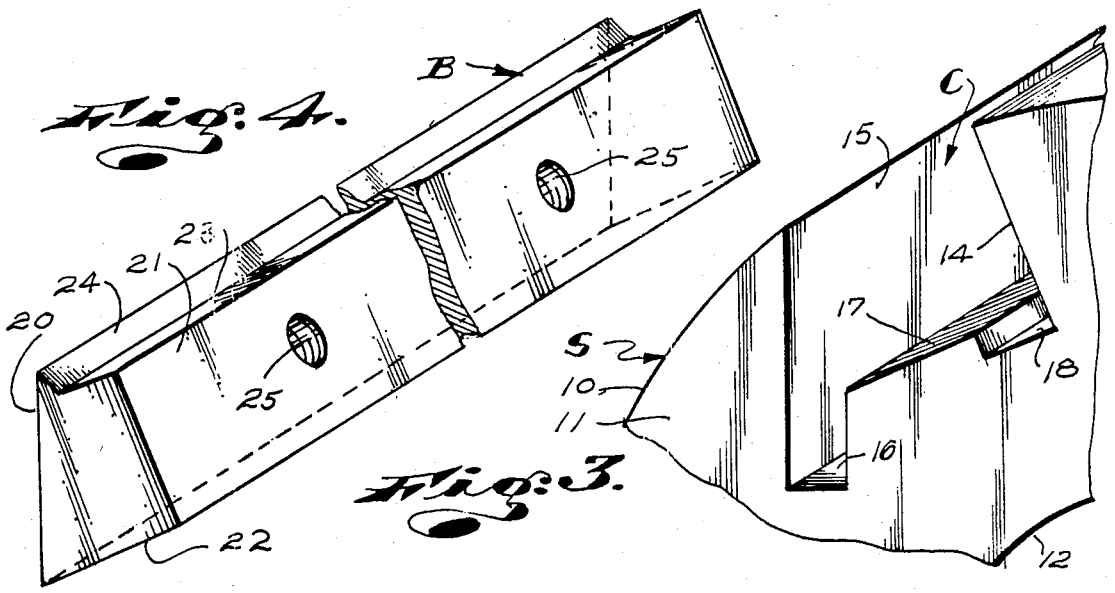
Fig. 4.
Fig. 3.
B
25
23
21
24
20
22
C
15
14
17
18
S
10
11
16
12

KNIFE HOLDER

This invention relates to the art of wood working and is particularly concerned with an improved planing knife structure for planing machines and the like.

BACKGROUND OF THE INVENTION

In the wood working art many power operated wood working machines are employed. Included among such machines are planing machines, multi-planing machines, joiner machines, thicknessing machines, parquet strip planing machines and various other wood working machines which include elongate power driven cylindrical rotors or knife driving shafts with pluralities of circumferentially spaced longitudinally extending substantially radially outwardly projecting cutting blades or knives. The knife driving shafts in such machines are generally cylindrical and are rotated at high speed. Wood to be worked upon is guided by the machines and advanced across a plane that is substantially tangential with the shaft and extends through a cord of the circular path of the knives, whereby the knives cut and remove predetermined surface portions of the wood worked upon and establish new surfaces thereon.

Throughout the many years that the machines of the character referred to above have been in common and regular use, the basic dimensions and cross-sectional configuration of planing knives has become substantially standardized and the structural character and features of the knife driving shafts which accommodate and hold the knives have become substantially standardized. Also, the knives and the knife driving shafts are provided in a multiplicity of standard lengths. The great majority of the different available lengths of knives and shafts vary uniformly between 60 millimeters and 810 millimeters. While it is not uncommon to find non-standard (odd size and shape) planing knives and knife driving shafts with non-standard knife mounting means, such non-standard structures are generally costly custom built structures made to perform special work or are cheap, inexpensive non-industrial quality structures specially designed and produced for sale to the non-professional, non-commercial user.

The standard planing knife is established of a length of flat tool steel that is rectangular in cross-section. The standard knife has straight, flat opposite ends, flat front and rear surfaces and straight, longitudinally extending inner and outer edges. The inner edge is flat and at right angle to the front and rear surfaces and the outer edge is a flat, forwardly and outwardly inclined surface that converges with the front surface at an acute angle to define a straight, longitudinally extending forwardly and outwardly disposed cutting edge. The outer inclined surface and/or cutting edge is established by grinding and honing or otherwise dressing the outer edge portion of the knife. The knife is established of sufficiently soft tool steel so that establishing a clean and sharp cutting edge and subsequently and repeatedly resharpening that cutting edge can be performed in a most effective and efficient manner. Since soft tool steel is used to establish such a knife, the thickness thereof must be and is made substantial in order to impart the knife with sufficient strength to withstand the workloads imposed upon it.

Standard planing knife driving shafts are provided in a number of different lengths and diameters. Further, such shafts are provided to accommodate and carry different numbers of planing knives. The standard means or structure embodied in driving shafts to accommodate and hold the knives comprises longitudinally extending substantially radially outwardly opening channels machined in the shafts to accommodate the knives and to accommodate elongate screw actuated clamp bars that serve to clamp the knives in fixed position in the channels. The channels have flat, radially extending rearwardly disposed forward side surfaces and flat, substantially forwardly disposed rear side surfaces that are inclined radially outwardly and forwardly relative to the forward surfaces so that the channels are in the nature of modified dovetailed grooves. The radial extent or depth of the channels and radial extent of the knives is such that when positioned in the channels with their rear surfaces in flat supported engagement with the rear surfaces of the channels, their outer cutting edge portions project radially outward from the channels in predetermined working position relative thereto. The clamp bars fit freely within the channels and have flat rearwardly disposed clamping faces that bear against the front surfaces of the knives and the holders. The clamp bars have longitudinally spaced jack bolts or similar screw fasteners threadedly engaged in them to project forwardly therefrom to engage the front surfaces of the channels. By suitably turning the jack bolts, the bars are moved rearwardly in the channels to urge and hold the knives in tight clamped engagement against the rear surfaces of the channels. Due to the dovetailed character of the channels when the knives, bars and jack bolts are set, their radial displacement from within the channels is effectively prevented and the resulting assemblies are safe to operate.

Assembly and proper setting of the knives in the channels of the driving shafts requires the exercise of special learned skill and is a time-consuming and often difficult to perform operation. To facilitate proper setting of planing knives in related channels of related driving shafts, the prior art has equipped such shafts with screw-operated support units spaced longitudinally of the channels to occur between the bottoms of the channels and the inner bottom edges of the knives. By appropriately turning and adjusting the screw-operated support units, the radial set positions of the knives in the channels and relative to the shafts can be accurately set. Due to certain structural characteristics and dimensional limitations, the noted support units must be engaged in special large diameter holes drilled substantially radially inward into the shaft through the planes of the rear surfaces of the channels and inward from the bottoms of the channels. Accordingly, the provision and use of such support units is limited to those few large size planing knife and driving shaft assemblies which present enough stock to accommodate the required holes therefor without adversely affecting the structural integrity of the shafts.

In FIGS. 12 and 13 of the accompanying drawings which will hereinafter be described, I have illustrated a prior art structure with a support unit, such as referred to above, embodied in it.

In the recent past, the prior art has provided a novel planing knife assembly comprising an elongate knife holder that is substantially similar in dimension and configuration with a standard planing knife but which is relieved to establish a forwardly and outwardly opening recess in its outer forward portion in which a thin, flat, double-edge disposable knife of hardened steel is set so that one edge thereof projects outward from the holder.

The knife holder is provided with a plurality of longitudinally spaced orienting and retaining pins that project forwardly into the recess and the double-edge disposable knife has orienting openings in and through which the pins project to properly orient and retain the knife and holder assembled. The disposable, double-edge knife and holder assembly is such that when one edge of the knife becomes dull, the knife can be easily and quickly turned over to present its other and sharp edge to perform work. The hardened steel disposable double-edge knife costs less than the cost of resharpening a standard reusable standard planing knife and each edge thereof will, as a general rule, remain effectively sharp twice as long as the cutting edge of a standard knife. Further, the disposable double-edge knife can be turned over and/or replaced in a very small fraction of the time that must be expanded merely to resharpen a standard knife.

The above noted disposable double-edge planing knife and knife holder assembly is such that it can be substituted for and used in place of a standard planing knife in a standard knife driving shaft.

In accordance with the above, it will be apparent that the noted new disposable double-edge planing knife and knife holder assembly affords great advantages over standard planing knives and constitutes a notable advance in the art.

While the above noted disposable double-edge planing knife and knife holder assembly has proven to afford many advantages over standard reusable planing knives, it has certain shortcomings which many users find extremely troublesome. The basic shortcoming found in the noted assembly is the tendency for the knife and holder to fall apart or separate during installation and adjustment of the cutting edge of the knife relative to the exterior of its related knife-driving shaft. This noted shortcoming becomes most troublesome in those instances where the knife-driving shaft is not provided with the above noted screw operated support units to orient the knife and holder assembly radially of its related shaft. In such cases, the knife and holder assembly must first be frictionally clamped in its related channel by its related clamp bar with its outer edge portions extending a substantial distance outward beyond its ultimate set position. Thereafter, the installer must carefully press and/or tap the assembly inward in the channel and relative to the shaft to desired set position. Due to the frequent inability to establish uniform pressure and frictional engagement between the several opposing bearing surfaces of the structure throughout the longitudinal extent thereof and the frequent inability to apply uniform pressure on and effect uniform sliding movement of the assembled parts, the holder and knife assembly becomes misaligned and cannot be set as desired without repeatedly releasing it and undertaking to reset it properly. It can be anticipated that one will have to release and proceed with resetting a knife and holder assembly two or three times before attaining a proper set of the outer cutting edge of the knife relative to the driving shaft.

OBJECT AND FEATURES OF THE INVENTION

It is an object of this invention to provide an improved disposable double-edge planing knife and knife holder assembly which is easier and more convenient to install and properly set in a related knife driving shaft than are those knife and knife holder assemblies provided by the prior art.

It is an object and feature of this invention to provide a knife and knife holder assembly of the character referred to having spring means at the inner bottom edge of the holder that engages the bottom of its related channel in its related driving shaft and which normally yieldingly urges the knife and holder assembly outward in the channel and relative to the shaft. Yet another object and feature of this invention is to provide a knife and holder assembly of the general character referred to having permanent magnet means carried by the holder adjacent the knife to releasably hold the knife in assembled relationship with the holder and which releasably holds a related clamp bar in assembled relationship with the knife and the holder.

Yet another object and feature of this invention is to provide a knife and holder assembly of the general character referred to above including permanent magnet means carried by the holder at a rear surface thereof to contact an opposing rear surface of a related channel in a related driving shaft to releasably hold the holder in engagement with said surface of the channel.

An object and feature of the invention is to provide a knife and holder assembly and a related driving shaft structure of the general character referred to above wherein the noted magnet means releasably holding the rear surface of the holder adjacent the rear surface of the channel exerts a holding force between the holder and said surface of the channel which establishes frictional resistance to planing movement between the holder and said rear surface of the channel; that is, substantially equal to the force of the noted spring means that normally yieldingly urges the holder outward and so that the holder can be easily and conveniently moved relative to said surface of the channel and to a desired set position by manually applied finger pressures.

It is another object and feature of this invention to provide a knife and holder assembly and related knife-driving shaft of the general character referred to above including spring means at the bottom edge of the holder engaging the opposing bottom radially outwardly disposed of a related channel in the shaft and yieldingly urge the assembled holder engaging the opposing bottom radially ouwardly disposed of a related channel in the shaft and yieldingly urge the assembled holder and knife outwardly in the channel and including spring loaded friction means carried by the holder yieldingly frictionally engaging an opposing radially extending rear surface of the channel to frictionally hold the knife and holder assembly between the rear surface of the channel and a screw actuated clamp bar in the channel against free outward movement of the assembly by the forces exerted by said spring means at the bottom edge of the holder.

It is an object and feature of this invention to provide a knife and holder assembly and a related knife-driving shaft structure of the general character referred to above wherein the noted clamp bar at and engaging the front surface of the knife and holder assembly is screw actuated into pressure holding engagement with the knife and holder assembly to bias the spring loaded friction means carried by the holder and engaging the rear surface of the channel so that said friction means normally yieldingly holds the knife and holder assembly inward in the channel with substantially the same force as is exerted by spring means at the bottom of the holder and which urge the knife and holder assembly outward in the channel and so that easy and convenient manual radial shifting and placement of the knife and holder assembly in the channel and relative to the shaft can be effected, prior to moving the clamp bar into tight clamping engagement with the knife and holder assembly.

An object and feature of my invention is to provide a knife and holder assembly of the general character referred to wherein the above referred to spring actuated friction means comprises spring loaded detent ball units positioned in openings entering the rear surface of the holder.

The foregoing and other objects and features of the invention will be fully understood from the following detailed description of typical preferred forms and embodiments of the invention, throughout which description reference is made to the accompanying drawings:

DESCRIPTION OF THE DRAWINGS

FIG. 1 is a modified perspective view showing one end and one side of the invention;

FIG. 3 is an isometric view of a portion of one end of the knife-driving shaft and showing one end of one channel therein;

FIG. 4 is an isometric view of a clamp bar;

FIG. 7 is a cross-sectional view of the knife taken substantially as indicated by line 7—7 on FIG. 5;

DETAILED DESCRIPTION OF THE INVENTION

Figures 2, 5, 6, 8:
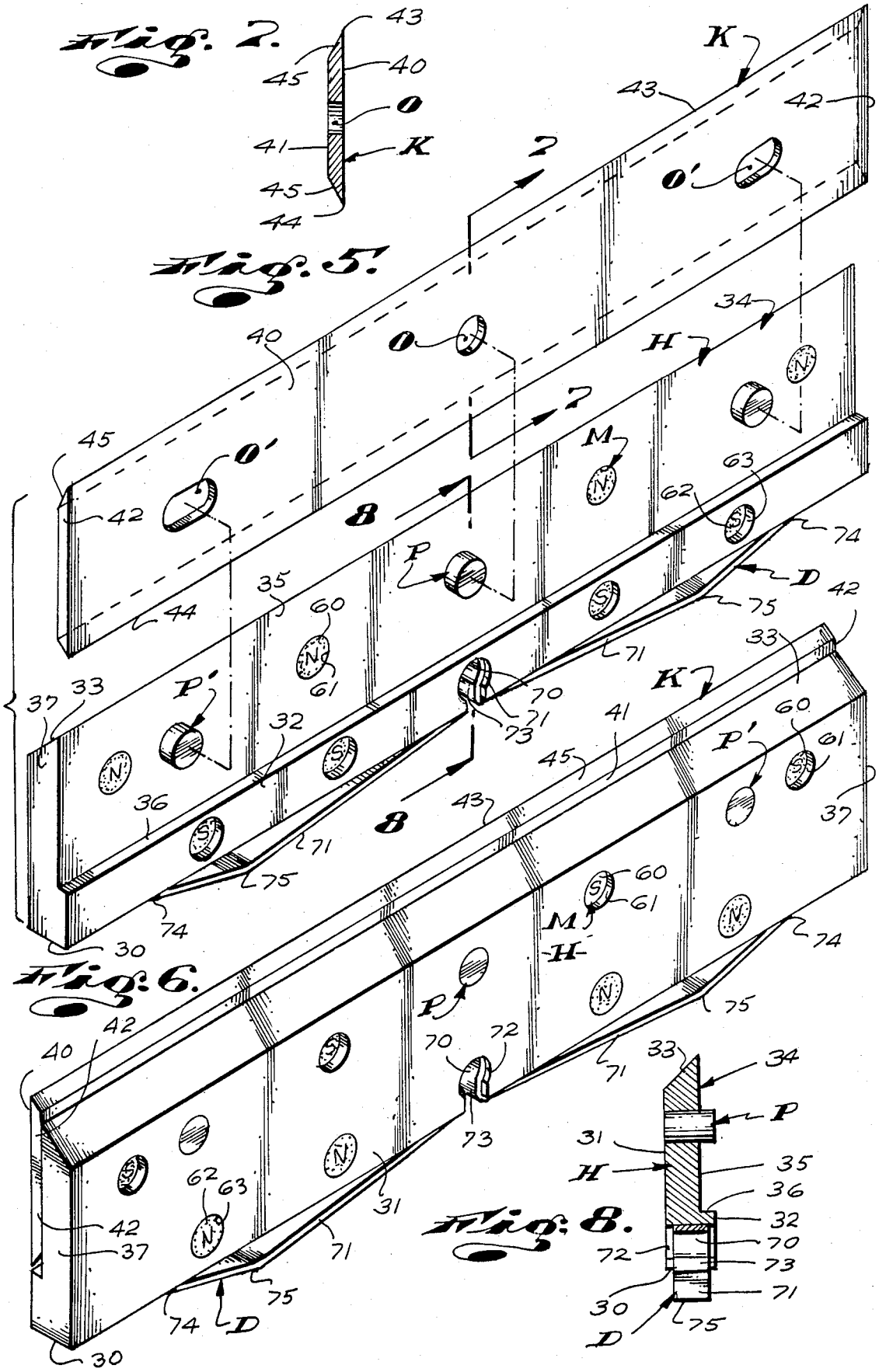
FIG. 2 is an enlarged detailed sectional view of a portion of the structure shown in FIG. 1 and taken substantially as indicated by line 2—2 on FIG. 1.
FIG. 5 is an exploded isometric view of a knife and knife holder assembly showing the front surfaces, outer edges and one end of the knife and knife holder.
FIG. 6 is an isometric view showing the rear surface, outer edges and one end of the knife and knife holder assembly.
FIG. 8 is a cross-sectional view of the knife holder taken substantially as indicated by line 8—8 on FIG. 5.
Figure 9:
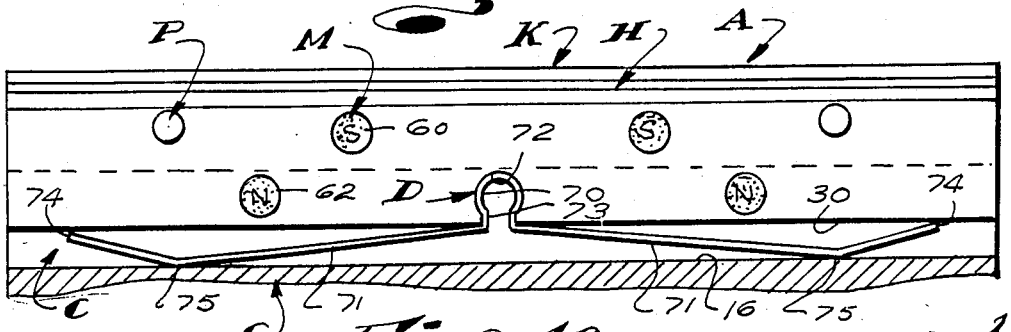
FIG. 9 is a rear view of a knife and knife holder assembly embodying the invention.

In FIG. 1 of the drawings, one typical and standard form of planing knife driving shaft S is shown. The shaft S is an elongate unitary part machined of tool steel and is characterized by a cylindrical outside surface 10, flat radially extending opposite ends 11, a central longitudinally extending drive shaft receiving opening 12 and four straight, circumferentially spaced, longitudinally extending, radially outwardly opening knife receiving channels C. The channels C have flat, radially extending front surfaces or sides 14 which are disposed rearwardly relative to the operating direction of rotation of the shaft S. The channels C have flat, substantially forwardly disposed rear surfaces or sides 15 that are spaced circumferentially rearward from the front surface 14 and which are inclined circumferentially forwardly and radially outward relative to the surfaces 14. In the case illustrated, the inside angle between the surfaces 14 and 15 is about 30°. The channels next include flat, outwardly disposed bottoms 16 which are normal to the plane of the rear surfaces 15.

In addition to the above, the channels C are shown formed with central longitudinally extending clamp bar supporting lands 17 at and along their inner forward bottom portions and are suitably grooved or relieved along the forward edge portions of the lands 17, as at 18, to provide working clearance adjacent the heads of jack bolts J carried by clamp bars B positioned within the channels, as clearly shown in FIG. 2 of the drawings and as will hereinafter be described.

It will be apparent that the channels C open radially outward and are in the nature of modified dovetail grooves.

It is to be understood that the particular form of channel C illustrated and briefly described above is only one typical standard form of knife-receiving channel established in standard knife-driving shafts to accommodate standard planing knives. The channels C can be changed or modified substantially in form and/or detail without affecting the present invention.

The structure here concerned with and shown in the drawings next includes the above noted clamp bars B. One clamp bar is provided for and positioned within each channel C. Each bar B is an elongate unitary machined metal part positioned freely within and extends longitudinally of its related channel from one end thereof to the other. Each bar B has a flat, rearwardly disposed clamping surface 20 in spaced parallel opposing relationship from the rear surface 15 of its related channel C and a front surface 21 in spaced opposing relationship from the front surface 14 of said channel.

In the case illustrated, each bar B has a flat, inwardly disposed inner surface 22 that occurs in flat supported engagement on the land 17 in its related channel C. It also has a flat outer surface 23 with a longitudinally extending outwardly projecting knife-supporting lip 24 along its outer rear edge.

Each clamp bar B next includes a plurality (at least two) of longitudinally spaced forwardly opening threaded openings 25 entering the front surface 21 thereof, on axes normal to the plane of the front surface 14 of its related channel C.

The above noted jack bolts J have threaded shanks 26 engaged in and projecting forward from related openings 25 in the bar B and have tool engaging heads 27 at the forward ends of the shanks. The heads 27 are accessible at or through the outer open sides of the channels C. The jack bolts 27 have flat, forwardly disposed stop surfaces or ends 28 which occur in stopped bearing engagement on the front surfaces 14 of the channels C.

It will be apparent that upon suitably turning the jack bolts J, they effectively forcefully move their related bars B rearward in their related channels C or allow for forward movement of the bars, as desired and as circumstances require.

It will be apparent and it is to be understood that the particular clamp bars B illustrated and described are illustrative of but one standard form of clamp bar provided by the prior art and that the details of construction and the form of those bars can be varied considerably without affecting or departing from the spirit of this invention. The same is true with respect to the jack bolts J that are shown in the drawings and described above.

In addition to the foregoing, the structure here concerned with and illustrated in the drawings includes a planing knife and holder assembly A arranged in each channel C and held in tight clamped engagement by and between the clamp bars B within the rear surfaces 15 of the channels C.

Each knife assembly A includes a knife holder H and a disposable double-edge planing knife K releasably carried by the holder.

The blade holder H of each assembly A is an elongate unitary part machined of metal and corresponds in longitudinal extent with its related channel C and clamp bar B. The holder H has a flat, longitudinally extending inner surface or bottom edge 30; a flat, longitudinally and substantially radially extending rear surface 31 that opposes the rear surface 15 of the channel C; a flat, longitudinally and substantially radially extending front surface 32 in opposing engagement with the rear clamping surface 20 of the clamp bar B and a radially outwardly and circumferentially forwardly inclined outer edge surface 33. In addition to the foregoing, the holder has a shallow, forwardly and outwardly opening longitudinally extending knife-receiving recess 34 with a flat, substantially radially and longitudinally extending substantially forwardly disposed knife supporting surface 35 in spaced opposing relationship with the surface 15 of the clamp bar B and an outwardly disposed longitudinally extending inner ledge 36 extending between the surfaces 32 and 35, as clearly shown in FIGS. 5 and 8 of the drawings.

Each holder H is positioned in its related channel C with its inner bottom 30 in opposing outward spaced relationship from the bottom 16 of the channel; its rear surface 31 in opposing bearing engagement with the rear surface 15 of the channel; its front surface 32 in engagement with its opposing inner portion of the clamp surface 20 of the bar B; its support surface 35 in spaced opposing relationship from its related outer portion of said clamp surface of the bar; and with its outer edge surface 33 extending radially outwardly and circumferentially forward relative to the outer surface 10 of the shaft S, as clearly shown in FIGS. 1 and 2 of the drawings.

Each holder has flat opposite ends 37 that occur on or in close proximity to the radial planes of their related ends 11 of the shaft S.

In addition to the above, each holder H has a plurality of longitudinally spaced knife orienting and retaining pins P on what will be called the central longitudinal axis of the support surface 34 and which project forward from the surface 34.

The holder H thus far described is old in the art. In furtherance of and in carrying this invention, the holder H further includes magnet means M, spring means D and/or friction means F, the details of which will be described in detail in the following.

Each knife K is a thin, flat, disposable, double-edge blade or knife established of hardened steel and is characterized by longitudinally and substantially radially extending forwardly and rearwardly disposed front and rear surfaces 40 and 41, straight, substantially radially extending opposite end 42, and straight, elongate, longitudinally extending, oppositely disposed substantially radially and circumferentially forwardly disposed sharp cutting edges 43 and 44. The cutting edges 43 and 44 are defined by substantially radially and circumferentially forwardly extending flat ground and honed surfaces 45 at the opposite longitudinal edges of the knife that converge with the front surface 40 at acute angle to establish the cutting edges.

In use, one sharp cutting edge is disposed substantially radially outwardly and the other is disposed substantially radially inwardly relative to the axis of the shaft. The knife is such that by turning it end for end, the radial disposition of the edges can be reversed, as desired and as circumstances require.

In addition to the above, each knife K has a plurality of longitudinally spaced orienting and retaining pin-receiving openings O at and in spaced relationship along the central longitudinal axis of the knife and positioned to slidably cooperatively receive the retaining and orienting pins P on the holder H.

In practice, the number and position of openings O and pins P in the knife and on the holder can be varied. In the case illustrated, three openings O and three pins P are shown, there being a central primary pin P and central primary opening O and two outer secondary pins P and outer secondary openings O, as clearly shown in FIG. 5 of the drawings. In practice, the primary opening O is round and the outer secondary openings are slightly elongated, longitudinally of the blade, to compensate for possible variations in the relative positioning of the pins.

The radial extent of each knife K is preferably slightly greater than the radial extent of the recess 34 in its related holder H and the longitudinal axes on which the pins P at and openings O are arranged is such that when the knife is positioned in the recess 34, with the pins P engaged through the openings O, the outwardly disposed cutting edge portion of the knife projects a limited predetermined distance outward from the outer edge 33 of the holder H, substantially as shown.

The pins P project forwardly from the support surface 35 of the recess 34 a distance no greater than the thickness of the knife so that the pins do not stop and prevent the clamp bar B from establishing flat uniform bearing engagement on and with the front surface 40 of the knife.

It will be apparent that the knife and holder assembly A is such that its position in its related channel C and relative to the outer surface 10 of the shaft S can be moved and adjusted prior to being clamped in set position by the bar B so that the outer cutting edge of the knife K is in desired spaced working relationship relative to the surface 10; whereupon it can be clamped in set position by the bar.

In accordance with prior art practices, the assembly A is adjusted and set in desired position relative to the channel C, bar B and the shaft S by first positioning it loosely in the channcel C rearward of the bar B. This operation is oftentimes interrupted by separation and displacement of the knife and holder and must be repeated several times. Thereafter, the clamp bar B is advanced rearwardly into sliding pressure engagement with the assembly A by operation of the jack bolts J. The assembly A is then manually slipped and moved about between the bar B and the rear surface of the channel to desired position. Unfortunately, all of the jack bolts J are seldom operated to exert uniform pressure engagement on the assembly A and/or desired movement of the assembly A is interfered with by surface irregularities and/or by dirt or foreign matter on and between the opposing working surfaces. As a result, pressure exerted onto one portion of the assembly A to properly position it results in excessive movement and/or displacement of that portion of the assembly and oftentimes results in undesired displacement of other portions of the assembly. As a result of the foregoing, positioning of the assembly A is often a time consuming and tedious operation. Finally, when the assembly is properly positioned, the jack bolts are tightened to set the assembly in place, preparatory for use.

Figure 14:
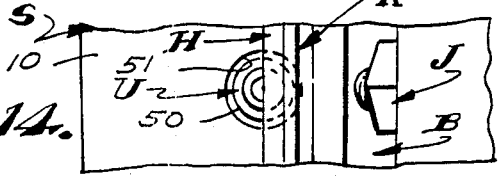
FIG. 14 is a view taken substantially as indicated by line 14—14 on FIG. 13.

To facilitate proper positioning of the assembly A, the prior art has resorted to the provision of a plurality of longitudinally spaced screw actuated support units U, such as is shown in FIGS. 14 and 15 of the drawings. Each support unit U consist of an internally threaded sleeve 50 engaged in an opening 51 drilled in the shaft S. The opening 51 enters the exterior of the shaft and terminates inward of its related channel C. The sleeve 50 has an upper outer end that stop against the bottom of the holder H to limit inward movement of the holder. The sleeve 50 carries support screw 52 which depend from the sleeve and engage the bottom of the opening 51. By adjusting the screw 52, from the outer open end of the opening 51 and through the sleeve, the radial position of the outer end of the sleeve is adjusted to engage the bottom edge of and limit inward movement of the holder H, as desired.

The principal shortcoming of the above noted prior art support units resides in the fact that such units can only be accommodated in large diameter driving shafts and require costly reworking or modification of preexisting standard shafts or the provision of specially made shafts in which the required openings 51 are preestablished.

As previously noted, an object of the present invention is to make the assembly an installation of knife holder and disposable knife assemblies, of the character illustrated and described above, in related channels of related knife-driving shafts easier, more convenient and quicker. In furtherance of the above, and in accordance with the present invention, a standard knife holder H is modified or made to include permanent magnet means M at the support surface 35 of the recess 34 to contact the rear surface 41 and to releasably hold a related disposable knife K adjacent said surface 35 and in oriented and retained engagement on the pins P of the holder. The magnet means M also serves to releasably hold the related clamp bar B in sliding engagement adjacent the front surfaces 32 and 40 of the holder and knife.

In the preferred form of the invention, the magnete means includes a plurality of longitudnially spaced cylindrical in cross-section magnets M, with flat north and south poles, engaged and set in longitudinally spaced forwardly opening cylindrical openings 61 drilled in the holder H at the support surface 35 thereof. The magnets 61 are preferably permanent ceramic magnet units. The openings 61 open forwardly at the surface 35 and the magnets 61 are set therein with their north poles flush with that surface. Accordingly, the north poles of the magnets contact and effectively releasably hold the knife K assembled with the holder H when the knife is fully engaged in the knife receiving recess 34 of the holder.

In practice, the axial extent of the magnets 61 is less then the thickness of the holder H so that the south poles thereof are spaced from and do not engage the flat rear surface 15 of the channel C and work to magnetically repel and urge the holder forward from contacting engagement therewith. That is, a magnetic gap is maintained between the south poles of the magnets and the rear surface of their related channel C.

In practice, the above noted gaps might be insufficient to be fully effective to prevent repelling and forward displacement of the holder relative to the rear surface of the channel. Accordingly, and in furtherance of the invention, the magnet means includes a plurality of longitudinally spaced, cylindrical in cross-section, secondary magnets 62 with flat north and south poles engaged and set in longitudinally spaced secondary openings 63 drilled in the holder H at the rear surface 31 thereof. The secondary magnets 62 are set in their related openings 63 with their north poles flush with the surface 31 so that when the holder is in place, the north poles of the magnets 62 engage the rear surface of their related channel and magnetically releasably hold the holder in place, adjacent said surface 15. The holding force of the secondary magnets 62 that contact the surface 15 of the channel C is notably greater than the repelling forces the magnets 60 might extend to urge the holder forward and out of engagement with the surface 15 of the channel C and effectively hold the holder in engagement on the surface 15 of the channel, as desired.

The south poles of the magnets 62 are spaced rearward from the knife K and/or the bar B to establish a suitable gap and to eliminate or substantially reduce an magnetic repelling forces that are greater than the holding force of the magnets 60 and which would or might displace the knife from the holder H.

In practice, in the case of large blade holders H, the thickness of which is sufficient to establish gaps between the magnets 60 and the rear surface 15 of the channels which are sufficiently great so that the south poles of the magnets 60 will not repel the holder from adjacent the surface 15, the secondary magnets 62 of the means M might be eliminated without adverse effect. However, the function of the magnets 62 to hold the holder adjacent the rear surface 15 of the channels C is sufficiently desirable so that the exclusion thereof might not be desirable.

Figure 12:
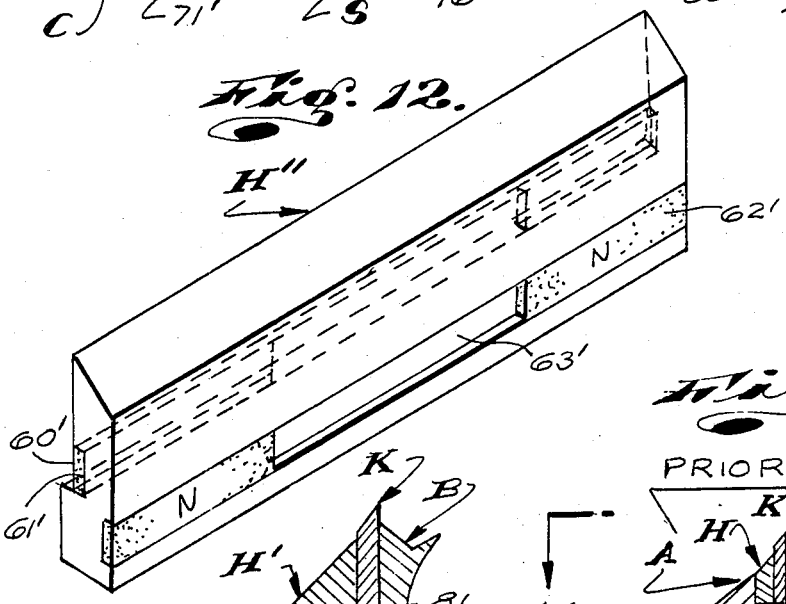
FIG. 12 is an isometric view of another form of holder.

While the magnets 60 and 62 of the means M are shown as being cylindrical parts engaged in drilled openings in their related holder H, it will be apparent that the form of the magnets and the manner in which they are set in the holder can be varied without departing from the spirit of this invention. For example and as clearly shown in FIG. 12 of the drawings, the magnets 60' and 62' can be in the form of elongate bar magnets engaged in channels 61' and 63' milled in the holder H'.

It is to be noted that while the magnets 60 and 62 releasably hold the knife K assembled with the holder H, the holder H engaged on the rear surface 15 of the channels C and the clamp bar B adjacent the front surfaces of the knife and holder with substantial force, they afford limited resistance to radial and/or longitudinal shifting of the knife and holder assembly A relative to the surface 15 and the clamp bar. The holding force of the magnet means creates frictional resistance to longitudinal and radial movement of the assembly A relative to the channel C and bar B. That frictional resistance afforded by the magnet means can be easily and advantageously adjusted by the number, arrangement, size and strength of the magnets without greatly and/or adversely affecting the basic "holding" function of the magnets. In accordance with the foregoing, the number, arrangement, size and strength of the magnets are preferably adjusted so that the frictional resistance to longitudinal and radial shifting of the related magnetically held parts is controlled and set so that the parts can be most effectively manually shifted relative to each other as desired and as circumstances require.

Next, and in furtherance of this invention, the assembly A is provided with and includes the above referred to spring means D. The spring means D is arranged at the inner or bottom 30 of the holder H and acts on and between the holder H and the bottom 16 of the channel C to normally yieldingly urge the knife and holder assembly A radially outward in the channel C.

In the form of the invention now under consideration, the spring means D is a single, inverted gull wing-like leaf spring with a semi-circular, outwardly projecting central body 70 and a pair of elongate, longitudinally and/or laterally outwardly extending wing-like belly springs 71. The belly springs 71 project laterally from the body 70 in opposite directions to underlie the opposite end portion of the holder H. The body 70 is captively engaged in a semi-cylindrical through opening 72 in the lower edge portion of the holder H. The opening 72 opens forwardly, rearwardly and downwardly, as clearly illustrated. The belly springs 71 have laterally outwardly and downwardly inclined inner portions and laterally outwardly and upwardly inclined outer portions. The inner ends of the inner portions of the belly springs 71 have outwardly turned connector portions 73 that extend through a gate at the inner open side of the opening 72 and which join the body 70. The outer portion of the belly springs 71 have free ends 74 that slidably engage and bear against the bottom surface 30 if the holder. The angularly related inner and outer portions of the springs 71 converge to establish downwardly or inwardly disposed bearing points 75 between the ends of the springs. The points 75 stop and bear on the bottom 16 of the channel C.

In accordance with the above, it will be apparent that the two springs 71 establish two laterally spaced downwardly disposed bearing points 75 at opposite end portions of the holder H.

Upon operation and use of the structure here provided, when the assembly A is manually urged inward in its related channel C, toward the bottom 16 thereof, the springs 71 are biased between the bottom 16 of the channel and the inner edge or bottom of the holder and normally yieldingly urge the holder H and the knife K carried thereby outwardly in the channel and relative to the shaft S.

In practice, the force exerted by the spring means D is preferably substantially equal to or slightly less than the countering forces of the magnet means M that resist radial shifting of the holder H in the channel C. If the two countering forces of the means D and means M are substantially equal, the assembled holder and knife can be manually moved inwardly and outwardly in the channel and let to stay in any desired set position by manually applied forces exerted thereon by one's fingers, before and preparatory to advancing the clamp bar B into tight clamping engagement with the assembly A.

If the force of the spring means D is a bit too great and works to override the holding force of the magnet means M and to shift the assembly A out in the channel C, the clamp bar B is moved into light pressure engagement with the assembly A, by operation of the jack bolts J, until the assembly A can be manually moved about in the channel C and will remain in set position when manually released.

It will be apparent that the countering forces of the spring means D and the magnet means M are directly functionally related and that in the preferred carrying out of the invention, are substantially balanced. Such balancing of the noted countering forces need not be precise. It is only necessary that the balance be such that the spring means D does not freely forcibly move the assembly A out in its related channel C when the clamp bar B is in other than tight clamping engagement therewith and such that the countering force of the magnet means M is not sufficiently greater than the force of the spring means D to prevent outward movement of the assembly A in its related channel by the application of light finger applied forces on the assembly A.

It will be apparent that in practice, the spring means D can include two or more gull-wing-like spring structures such as shown in the drawings. Further, the spring means D can include other forms of springs without adversely affecting or departing from the spirit of this invention. For example, as shown in FIGS. 10 or 11 of the drawings, the spring means D' includes elongate inwardly and outwardly extending helical compression springs 71' engaged in and projecting downwardly from a plurality of longitudinally spaced openings 76 entering the bottom 30' of the holder H'.

Figure 10:
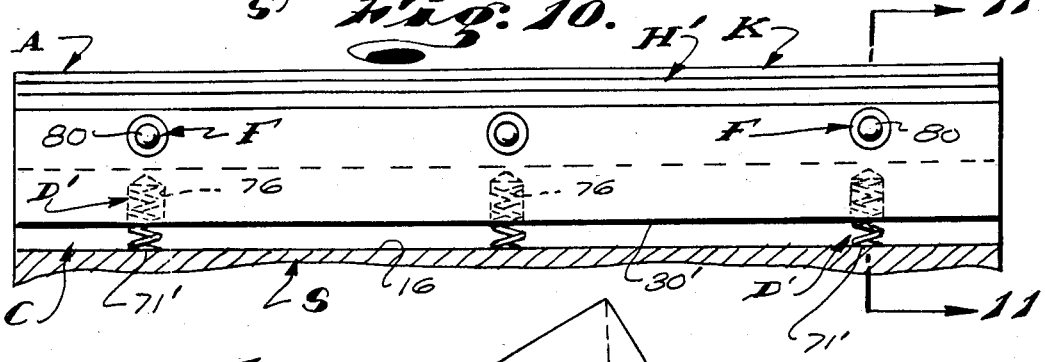
FIG. 10 is a rear view of another form of knife and knife holder assembly.
Figure 11:
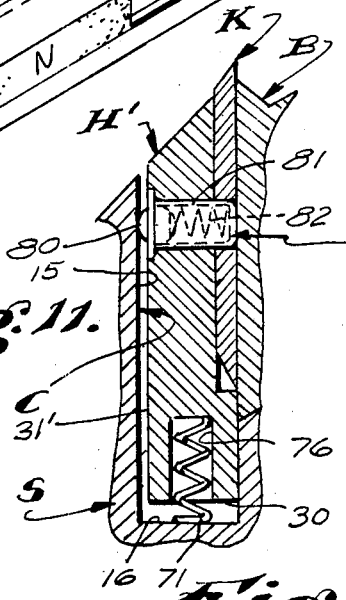
FIG. 11 is an enlarged detailed sectional view taken substantially as indicated by line 11—11 on FIG. 10 and showing structure related to the knife and knife holder assembly in dotted lines.
Figure 13:
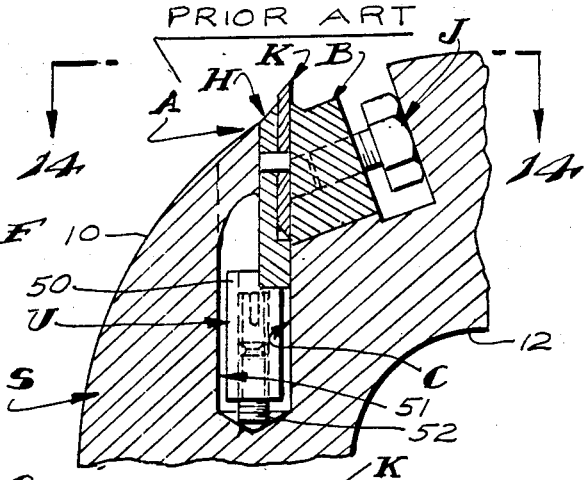
Fig. 13. PRIOR ART
FIG. 13 is a cross-sectional view similar to FIG. 2 showing a prior art structure.

In the form and embodiment of my invention shown in FIGS. 10 and 11 of the drawings, the holder H' includes spring loaded friction means F that yieldingly frictionally engage the rear surface 15' of the channel C'. The means F is shown as including a plurality of longitudinally spaced spring loaded balls 80 carried in openings 81 entering the rear surface 31' of the holder H' and acted upon by compression springs 82 positioned forward of the balls. The balls normally project a short distance rearward from within the openings 81 and from the surface 31' of the holder and are yieldingly shiftable into full engagement in the openings. In operation and use, when adjusting the position of the holder H' and its related knife K' in its related channel C', the clamp bar B' is urged into sufficiently tight or clamping engagement with the holder to urge it rearwardly towards the surface 15' of the channel and to urge the balls 80 into yielding pressure engagement with said surface 15'. The pressure between the surface 15' and the balls 80 is adjusted by actuation of the jack bolts J' and movement of the clamp bar so that the forces exerted by the balls which resist free shifting of the holder in the channel C is substantially balanced with or counters the forces exerted by the spring means D' and so that the holder and its related knife can be easily and conveniently manually moved about and set within the channel C. When the bar is manually set in desired position, the clamp bar B is moved rearwardly to move the surface 31' of the holder into tight clamped engagement with the surface 15' of the channel C' and the balls 80 are displaced forwardly into full engagement in the openings 80, out of interfering engagement between the surface 15 and the holder.

In the case illustrated, the means F is established by standard ball detent units with outer cylindrical cases that are set in openings through the holder and which establish the orienting and retaining pins P.

It is to be noted that the means F serves the same or similar function as the magnets 62 of the means M, in substantially the same way. In practice, the means F can be used in place of the magnets 62 or can be used to supplement the magnets 62, as desired or as circumstances require.

In accordance with the broader aspects and spirit of this invention, the magnets 62 of the means M and the spring loaded balls 80 of the friction means F are both force exerting friction means that act between the rear surface of the holder H and the opposing rear surface of the channel to frictionally hold the holder in set position relative to the rear surface of the channel against those forces of the spring means that normally yieldingly urge the holder outward in the channel.

With the structure illustrated in the drawings and described above, it will be apparent that the present invention provides an improved disposable double-edge planing knife holder which is such that it effectively retains a related knife in assembled relationship therewith and effectively holds and/or maintains itself in manually set position in a related channel in a related planing driving shaft, preparatory to its being clamped tight in said channel by a related screw-actuated clamp bar. The structure therefore enables the whole of the assembled parts to be assembled, arranged and adjusted in desired set position and thereafter tightly clamped in that set position easily, quickly and with the exercise of minimum special skill.

Having described typical preferred forms and embodiments of the invention, I do not wish to be limited to the specific details herein set forth but wish to reserve to myself any modifications and/or variations that may appear to those skilled in the art and which fall within the scope of the following claims.

Having described my invention, I claim:

1. In combination, an elongate, planing knife driving shaft with opposite ends, a cylindrical outer surface and a plurality of circumferentially spaced, longitudinally extending, radially outwardly opening channels with circumferentially spaced, circumferentially rearwardly and forwardly disposed front and rear channel surfaces and a radially outwardly disposed bottom, an elongate clamp bar with circumferentially spaced forwardly and rearwardly disposed front and rear surfaces positioned in each channel with its front and rear surfaces in spaced opposing relationship with said forwardly and rearwardly disposed channel surfaces, a plurality of longitudinally spaced jack screw means in each channel between the bar therein and the front channel surface and operating to effect forward and rearward movement of the bar in the channel, an elongate planing blade holder in each channel with a rearwardly disposed rear surface opposing and movable into and out of engagement with the forwardly disposed rear channel surface, a longitudinally extending inner bottom surface spaced radially outward from the bottom of the channel, a forwardly disposed front surface opposing and movable into and out of engagement with the rear surface of the bar, and a longitudinally extending outer edge adjacent the outer surface of the shaft, the front surface of each holder has a forwardly and outwardly opening knife-receiving recess with a forwardly disposed support surface in spaced opposing relationship with the rear surface of a related bar and a plurality of longitudinally spaced orienting and retaining pins carried by each holder and projecting forwardly from said support surface thereof, an elongate knife with forwardly and rearwardly disposed front and rear surfaces, longitudinally extending inner and outer cutting edges and a plurality of longitudinally spaced forwardly and rearwardly opening pin-receiving openings, removably engaged in the recess of each holder with its rear face stopped against its related support surface, its front face opposing and releasably engaged by the rear surface of its related bar, its outer cutting edge projecting outward from the outer edge of its related holder and with said pins on its related holder slidably releasably engaged in said openings, said jack means are manually operable to move the bars forwardly and rearwardly in their channels and into and out of engagement with their related holders to selectively releasably hold the assembled holders and knives in sliding friction and tight clamped engagement between their related bars and rear channel surfaces, said holders further include and carry spring means extending longitudinally of and inward from their bottom edges and engaging the bottoms of the channels and normally yieldingly urging the holders radially outward in the channels relative to the rear channel surfaces and the bars.

2. The combination set forth in claim 1 wherein said holder further includes magnet means releasably holding the knives in the recesses of the holders and in oriented and retained engagement with said pins, said magnet means includes pluralities of longitudinally spaced permanent magnets with north and south poles set within the holders with their north poles flush with the support surfaces of the holders and normally engaging the rear faces of the knives and wtih their south poles spaced forward from their related rear channel surfaces.

3. The combination set forth in claim 2 wherein said magnet means further includes secondary magnets releasably holding the holders rearward in their related channels with their rear surfaces in opposing frictional sliding engagement with their related rear channel surfaces and including a plurality of longitudinally spaced permanent magnets with north and south poles set within the holders with their north poles flush with the rear surfaces of the holders and normally engaging their related rear channel surfaces and with their south poles spaced rearward from their related knives and bars.

4. The combination set forth in claim 1 wherein said holders further includes friction means at and between their rear surfaces and their opposing related channel surfaces, said friction means establishes frictional resistance to relative movement of the holders when they are out of tight clamped engagement with their adjacent surfaces of the channels, said friction means including a plurality of longitudinally spaced permanent secondary magnets with north and south poles set within the holders with their north poles flush with the rear surfaces of the holders and normally engaging the rear channel surfaces of their related channels and with their south poles spaced rearward from the knives and the bars.

5. The combination set forth in claim 1 wherein said holder further includes friction means at and between the opposing rear surfaces of the holders and their related channels and establishing frictional resistance to relative planar movement of those surfaces when they are out of tight clamped engagement with each other, said friction means including a plurality of longitudinally spaced balls carried by the holders and normally releasably engaging the rear channel surfaces of their related channels, said balls are shiftable from a normal position where they project through and rearwardly from the rear surfaces of the holders to actuated positions where they occur forward of said rear surfaces of the holders, and loading springs forward of the balls yieldingly urging the balls rearwardly to their normal positions.

6. The combination set forth in claim 2 wherein said holder further includes friction means at and between the opposing rear surfaces of the holders and their related channels and establishing frictional resistance to relative planar movement of those surfaces when they are out of tight clamped engagement with each other, said friction means including a plurality of longitudinally spaced balls carried by the holders and normally releasably engaging the rear channel surfaces of their related channels, said balls are shiftable from a normal position where they project through and rearwardly from the rear surfaces of the holders to actuated positions where they occur forward of said rear surfaces of the holders, and loading springs forward of the balls yieldingly urging the balls rearwardly to their normal positions.

7. The combination set forth in claim 3 wherein said holder further includes friction means at and between the opposing rear surfaces of the holders and their related channels said friction means establishes frictional resistance to relative planar movement of those surfaces when they are out of tight clamped engagement with each other, said friction means including a plurality of longitudinally spaced balls carried by the holders and normally releasably engaging the rear channel surfaces of their related channels, said balls are shiftable from a normal position where they project through and rearwardly from the rear surfaces of the holders to actuated positions where they occur forward of said rear surfaces of the holders, and loading springs forward of the balls yieldingly urging the balls rearwardly to their normal positions.

* * * * *